United States Patent [19]

Gisselberg, III

[11] Patent Number: 4,532,861

[45] Date of Patent: Aug. 6, 1985

[54] CAN CRUSHER

[76] Inventor: Paul D. Gisselberg, III, E. 610 - 42nd, Spokane, Wash. 99203

[21] Appl. No.: 603,714

[22] Filed: Apr. 25, 1984

[51] Int. Cl.[3] ..... B30B 9/32

[52] U.S. Cl. ..... 100/233; 100/293; 100/295; 100/902

[58] Field of Search ..... 100/902, 293, 295, 233, 100/234, 98 R; 241/99; 99/582, 583

[56] References Cited

U.S. PATENT DOCUMENTS

| | | | |
|---|---|---|---|
| 2,111,997 | 3/1938 | Stephens | 100/233 X |
| 2,446,898 | 8/1948 | Alvarez . | |
| 3,776,129 | 12/1973 | Carlson . | |
| 3,777,659 | 12/1973 | McCarten . | |
| 4,212,242 | 7/1980 | Willis . | |
| 4,292,891 | 10/1981 | Shelley . | |
| 4,333,397 | 6/1982 | Modes . | |
| 4,442,768 | 4/1984 | Bailey | 100/902 X |

*Primary Examiner*—Billy J. Wilhite

*Attorney, Agent, or Firm*—Wells, St. John & Roberts

[57] ABSTRACT

A can crusher is composed of two basic components. A base member is mountable to a stationary surface and a lever is pivotably mounted to the base. The base includes a stationary anvil surface for receiving the side wall of a can. An inclined stationary abutment surface is affixed to the base surface to receive and abut one end of a can. The abutment surface is inclined at an acute angle to the anvil surface. An elongated lever is pivoted to the base end opposite the inclined abutment surface. The lever includes a flat crusher surface thereon for engaging a can end opposite the end presently engaging the inclined abutment surface. The lever can be manually operated to crush the can by initially moving the can axially against the inclined abutment surface. This folds the engaged end over. The remaining end is folded over by the crusher surface. The folding action may continue until the two can ends are crushed flat against the previously cylindrically can side wall.

8 Claims, 7 Drawing Figures

FIG 3
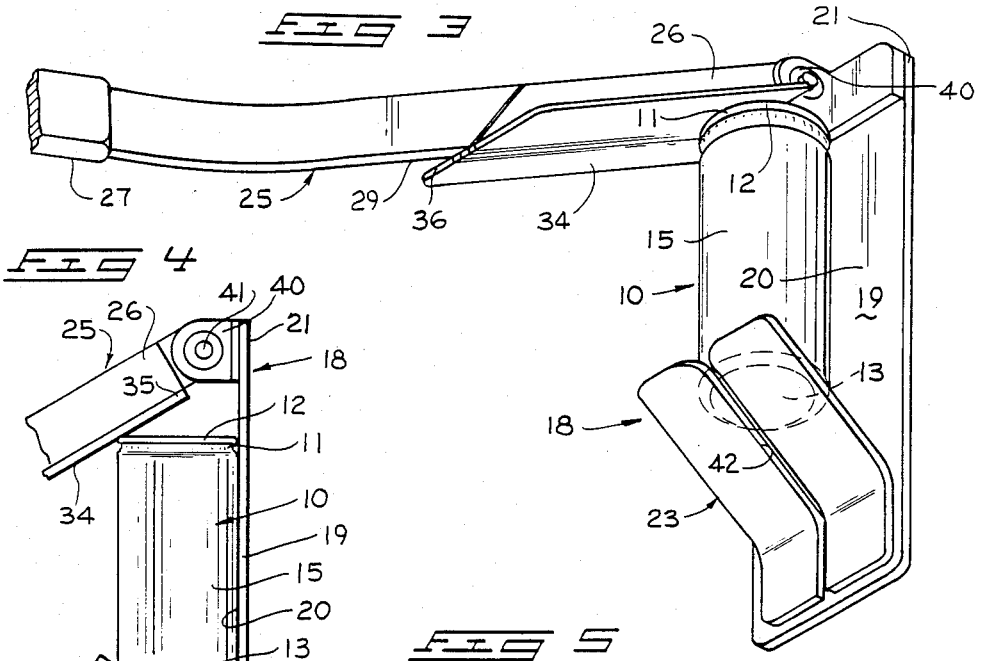
FIG 4
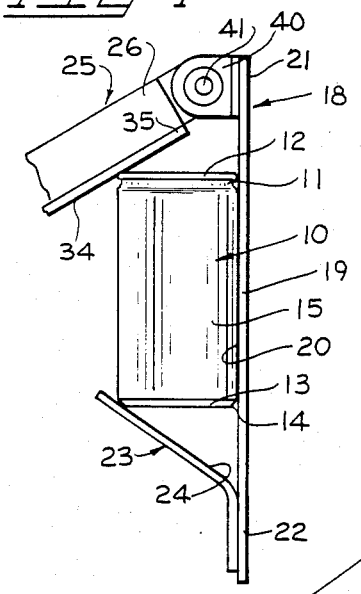
FIG 5
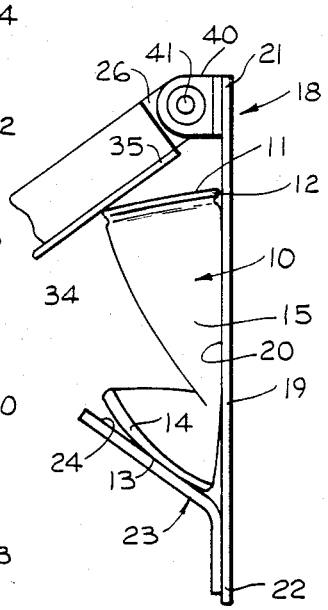
FIG 6
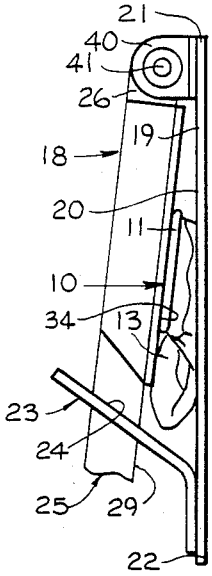
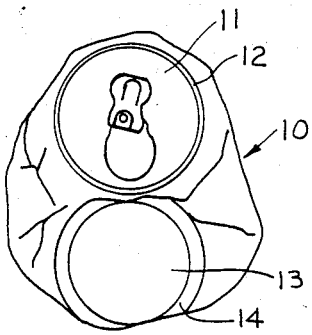
FIG 7

CAN CRUSHER

FIELD OF THE INVENTION

The present invention relates to crushing of cans by manually operated crushing mechanisms.

BACKGROUND OF THE INVENTION

The ever increasing need for recycling aluminum cans has led to the development of many different manually operable can crushers. Most operate on the principles of leverage to maximize mechanical advantage in crushing the cans. However, the complicated linkages and mechanisms involved increase manufacturing expense and, ultimately, the retail purchase price. High retail cost for such an item acts as a deterrent rather than an incentive for individuals to begin saving aluminum cans for recycling. The relatively low price per pound of aluminum will not quickly offset the purchase cost of such an item.

It has therefore remained desirable to obtain some form of apparatus that will eventually crush aluminum cans to a compact easily stored condition, and that can be inexpensively manufactured and retailed at a reasonable cost. It also remains desirable to obtain some form of crushing mechanism that will effectively crush aluminum cans with a minimal applied force.

Examples of existing can crushers may be found in U.S. Pat. Nos. 3,777,659; 3,776,129; 2,446,898; 4,333,397; 4,292,891; and 4,212,242. These patents all disclose various lever operated mechanisms for crushing cans. While the mechanisms of some are quite simple (U.S. Pat. Nos. 3,776,129 and 3,777,659) the operating forces required to crush the cans with these simplified devices is significant. The remaining, more complicated mechanisms involve multiple-step crushing procedures or complex mechanisms for achieving the desired results.

BRIEF DESCRIPTION OF THE DRAWINGS

A preferred form of the present invention is illustrated in the accompanying drawings, in which:

FIG. 3 is a pictorial view of the present crusher with a can secured therein;

FIG. 4 is a side elevation view showing components of the present crusher in relation to a typical can;

FIG. 5 is an operational view showing a can partially crushed by the present crusher;

FIG. 6 is an operational view similar to FIG. 5 only showing the can in a completely crushed state; and;

FIG. 7 is an elevation view of a can crushed by the present crusher.

DETAILED DESCRIPTION OF THE PREFERRED EMBODIMENT

Figure 1:
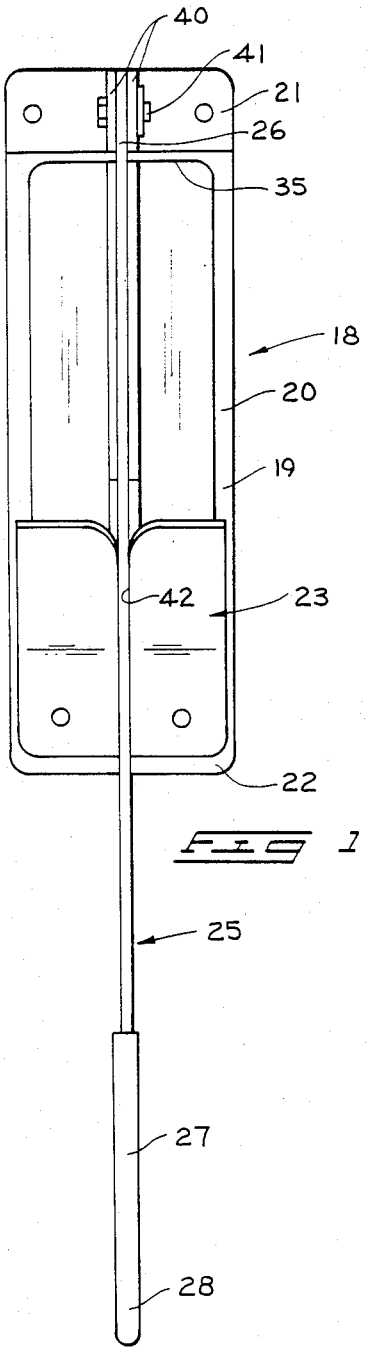
FIG. 1 is a front elevation view of the present crusher.

In compliance with the constitutional purpose of the Patent Laws "to promote the progress of science and useful arts" (Article 1, Section 8), applicant submits the following disclosure of the invention.

It is the purpose of the present invention to apply mechanical advantage for manually crushing cans of the nature shown generally in FIG. 4. The can is shown in FIG. 4 by the reference numeral 10. It includes a top end 11 distinguished by a circumferential rim 12. An opposed bottom end 13 is distinguished by a beveled edge 14 leading from the substantially cylindrical side wall 15 to the flat bottom surface. This configuration is somewhat typical with only minor variations to most forms of aluminum beverage cans.

The present crusher is generally shown at 18. It is utilized to received individual cans 10 and to crush them from their normal cylindrical configuration to a flat, compacted condition as shown graphically in FIGS. 6 and 7.

The present crusher 18 includes a base 19 that can be secured by appropriate fasteners to any solid horizontal to upright surface such as a floor or wall. The base 19 includes an outwardly exposed anvil surface 20 that extends between opposed base ends 21 and 22. The anvil surface 20 is preferably flat and planar to abut the cylindrical side surface 15 of an aluminum can as indicated in FIG. 4.

A stationary abutment 23 is provided at end 22 of the base 19. The abutment 23 includes an inclined abutment surface 24 for receiving and engaging against an end of a can placed against the anvil surface 20. The abutment surface 24 is inclined at an acute angle to the anvil surface. This angle may lie within a range between 35° and 75° but is preferably approximately 55°. The inclined surface 24 crimps the end of a can engaged thereby as the crushing procedure is initiated. This procedure will be discussed in greater detail below.

The present crusher 18 includes an elongated lever 25. The lever 25 may be constructed of bar stock, having a rectangular cross section and extending from an inside end 26 to a handle 27 at an outward end 28. An edge 29 of the lever represents one of the short sides for the rectangular cross-sectional configuration.

The lever edge 29 is substantially coplanar to a crusher surface 34 rigidly affixed to the lever 25. The crusher surface 34 extends to opposite sides of the edge 29. It forms a flat planar surface for engaging and crushing the individual cans against the anvil surface of the base.

Figure 2:
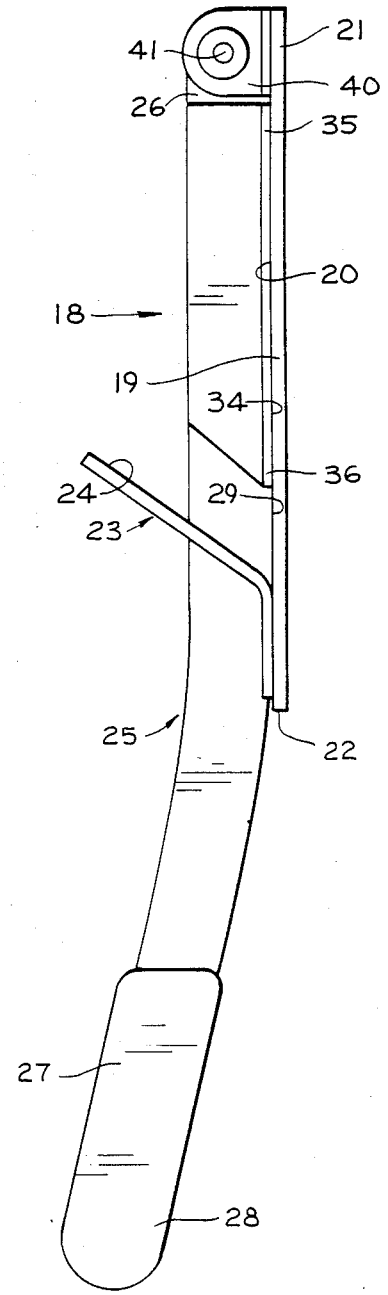
FIG. 2 is a side elevation view thereof.

A bracket means 40 is provided at the base end 21 for pivotably mounting the inside lever end 26. Bracket means 40 pivotably mounts the lever to the base for free pivotal motion about an axis defined by a pivot pin 41. The pin 41 joins the inside lever end 26 and bracket means 40 and locates the axis outward of the anvil surface 20 such that the lever can be pivoted to a closed position wherein the lever edge 29 and crusher surface 34 rest in flush engagement with the anvil surface 20. This condition is shown in FIG. 2.

The stationary abutment 23 is slotted to allow movement of the lever 25 to its closed position. The slot is indicated at 42 and can be formed by separating the stationary abutment 23 into two members spaced to opposite sides of the lever. This leaves an open passage or slot through which the lever can pivot freely. The inclined abutment surface 24 is thereby divided with approximately half of the surface 24 extending to each side of the lever at its closed position as shown in FIGS. 1. 2 and 6.

The overall length of the crusher surface 34 is such that end 36 will just clear the outward edge of the stationary abutment 23 as the lever swings between its open and closed positions. It is also spaced with an inside crusher surface end 35 closely adjacent the inward lever end 26. The actual distance between the crusher surface ends 35, 36 is slightly greater than the overall height of a can between its opposed ends 11, 13.

The relationship of anvil surface 20, abutment surface 24, and crusher surface 34 is such that a can may be received by the crusher with the above elements in the particular orientation shown in FIG. 4. The can is received with its cylindrical side wall 15 resting flush against the anvil surface 20. Its bottom end 13 may engage the inclined abutment surface 24. The crusher surface 34 may engage the rim 12 of the can on the same side as the inclined abutment surface 24, and forms an acute angle with the anvil surface 20.

It is noted that the can is oriented with its top end 11 engaging the crusher surface 34 and the bottom end 13 engaging inclined abutment surface 24. This is the preferred orientation of the can for best results when crushing. The can will more easily fold on itself in response to forces applied to the lever when the crusher surface acts against the top rim of the can. However, the present crusher is also capable of crushing cans that have been positioned in the crusher and in inverted orientation (with the top end 11 engaging the inclined abutment surface 24).

FIGS. 5 and 6 are illustrative of the crushing procedure.

The can is crushed as manual force is applied to the lever 25. This is done by grasping the lever at the handle 27 and forcing it to pivot about the axis of pin 41 toward the base 19. The crusher surface 34 acts against the can top end 11 as this motion progresses, forcing it against the anvil surface 20 and axially along its length against the inclined abutment surface 24. The axial forces and the inclined abutment surface co-act to initially crimp the side wall of the can adjacent the bottom end 13 (FIG. 5). The bottom end of the can is then forced to fold in the orientation of the inclined abutment surface 24 over the presently crimped side wall.

The pivoting crusher surface 34 changes its angular relationship with the anvil surface 20 as the lever pivots toward the closed condition. As this angle diminishes, radial crushing force at the top end of the can increases. This force increases to the point where the top can end 11 is crimped over onto the can side as shown in FIG. 6. Thus the two can ends 11 and 13 are folded over onto the side wall of the can. Continued forceful movement of the lever toward the closed condition will cause the crusher surface to forcibly flatten the can ends against the crushed side wall 15.

The result is a flat can configuration (FIG. 7) with the circular can ends oriented in substantially the same plane. Cans flattened in this manner are easily stored and can accumulate without requiring a large storage space. The crushed cans may be collected over a period of time until a sufficient quantity by weight is collected to justify transport to a recycling center.

It is pointed out that the present crusher makes use of a single moving part, the lever. All other parts of the present device are immovable relative to the elements they are mounted on. This greatly reduces overall construction costs and correspondingly reduces the ultimate cost to the consumer. The relationship of the crushing surfaces 19, 24, and 34 also minimizes the manual effort required by the user.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A can crusher, comprising:

a base having a flat anvil surface thereon extending between opposed base ends;

a rigid elongated lever having a handle at an outward handle end and a remaining inward end;

a crusher surface on the lever adjacent the remaining lever end extending along the lever from an end adjacent the remaining lever end to an outward end spaced toward the lever handle;

bracket means mounted on the base at one of the base ends thereof for mounting the lever at the end end for pivotal movement about an axis parallel to the flat anvil surface, between a closed position with the flat crusher surface in flush engagement with the anvil surface, and an open position wherein the flat crusher surface is pivoted away from the anvil surface to a can receiving position such that a can may be received between the crusher and anvil surface; and a stationary abutment affixed to the base at the end thereof opposite the one end mounting the bracket means, having a can end abutment surface thereon inclined at an acute angle to the anvil surface and adjacent the outer crusher surface end, said abutment being slotted to receive the lever with the abutment surface extending to opposite sides of the lever at the closed position thereof.

2. The can crusher of claim 1 wherein the lever is formed of an elongated bar of rectangular cross section having a narrow edge thereof coplanar with the flat crusher surface.

3. The can crusher of claim 1 wherein the inclined abutment surface is oriented in relation to the anvil surface at an angle between 35 and 75 degrees.

4. The can crusher of claim 1 wherein the inclined abutment surface is oriented in relation to the anvil surface at an angle of approximately 55 degrees.

5. A can crusher for cans having substantially flat ends joined by substantially cylindrical side walls, the crusher comprising:

a base having a flat elongated anvil surface for and abutment with a can side wall;

a bracket on the base at one end thereof and adjacent the anvil surface;

a lever arm having an inside end mounted to the bracket for pivotal motion about axis parallel to the anvil surface between an open position pivoted away from the anvil surface and a closed position adjacent the anvil surface, and extending to an outward handle end remote from the pivot axis;

a crusher surface affixed on the lever arm adjacent the inside end and in a plane substantially parallel to the pivot axis, for engaging a can end resting with its side wall against the anvil surface of the base at the open lever arm position and pivoting with the lever arm to closed position adjacent the anvil surface;

an abutment affixed to the base at an end thereof opposite the one end mounting the bracket and having a stationary inclined abutment surface thereon oriented at an acute angle to the anvil surface of the base, for engaging an end of a can; and wherein the crusher surface, anvil surface and inclined abutment surface cooperate to progressively crush a can placed with one end thereof against the inclined abutment surface and the side wall thereof against the anvil surface in response to manual force applied to move the lever arm toward the closed position, such that the can ends will be progressively folded toward one another and flattened along with the can side wall, as the lever arm is manually pivoted about the axis toward the base, said abutment being slotted to receive the lever arm, with the abutment surface extending to opposite sides of the lever arm at its closed position.

6. The can crusher of claim 5 wherein the lever arm is formed of an elongated bar of rectangular cross section having a narrow edge thereof coplanar with the flat crusher surface.

7. The can crusher of claim 5 wherein the inclined abutment surface is oriented in relation to the anvil surface at an angle between 25 and 75 degrees.

8. The can crusher of claim 5 wherein the inclined abutment surface is oriented in relation to the anvil surface at an angle of approximately 55 degrees.

* * * * *